United States Patent [19]

Florian et al.

[11] 4,351,058

[45] Sep. 21, 1982

[54] INDUCTION CRUCIBLE FURNACE AND METHOD FOR ITS PREPARATION

[76] Inventors: Rudolf Florian, Mossenberg 34, D-4933 Blomberg; Albert Herrmann, Bokelfennerstrasse 24, D-4815 Stukenbrock, both of Fed. Rep. of Germany

[21] Appl. No.: 122,715

[22] Filed: Feb. 19, 1980

[30] Foreign Application Priority Data

Feb. 22, 1979 [DE] Fed. Rep. of Germany ..... 2906815

[51] Int. Cl.[3] ..... F27B 14/10; F27D 1/10; H05B 5/16

[52] U.S. Cl. ..... 373/155; 373/156

[58] Field of Search ..... 13/26, 27, 35

[56] References Cited

U.S. PATENT DOCUMENTS 2,793,242 5/1957 Beckius et al. ..... 13/27
3,401,227 9/1968 Dunlevy et al. ..... 13/26
3,666,250 5/1972 Hensenne ..... 13/35

FOREIGN PATENT DOCUMENTS 81908 10/1963 France ..... 13/35
51-4925 2/1976 Japan ..... 13/35

*Primary Examiner*—Bernard Roskoski
*Attorney, Agent, or Firm*—Michael J. Striker

[57] ABSTRACT

An induction crucible furnace includes a housing having a bottom wall and side walls which define a furnace cage. A prefabricated refractory crucible made of a mixture of a dry ramming material, a sintering agent and a cold-curing binder is disposed within the furnace cage with a clearance which is filled with a non-sintering granular material sealed within the furnace with a patching compound. A plurality of induction coils are disposed within the furnace cage and are separated from a layer of the non-sintering granular material by a heat-protective layer. In a method of manufacturing of the induction crucible furnace a refractory crucible is placed onto a bed of a non-sintering granular material disposed on the bottom wall of the furnace housing. A non-sintering granular material is filled into an annular space between the furnace cage and the crucible, then this material is compacted, closed and the furance is started up to reach the temperatures causing sintering of the mixture of the prefabricated refractory crucible.

5 Claims, 1 Drawing Figure

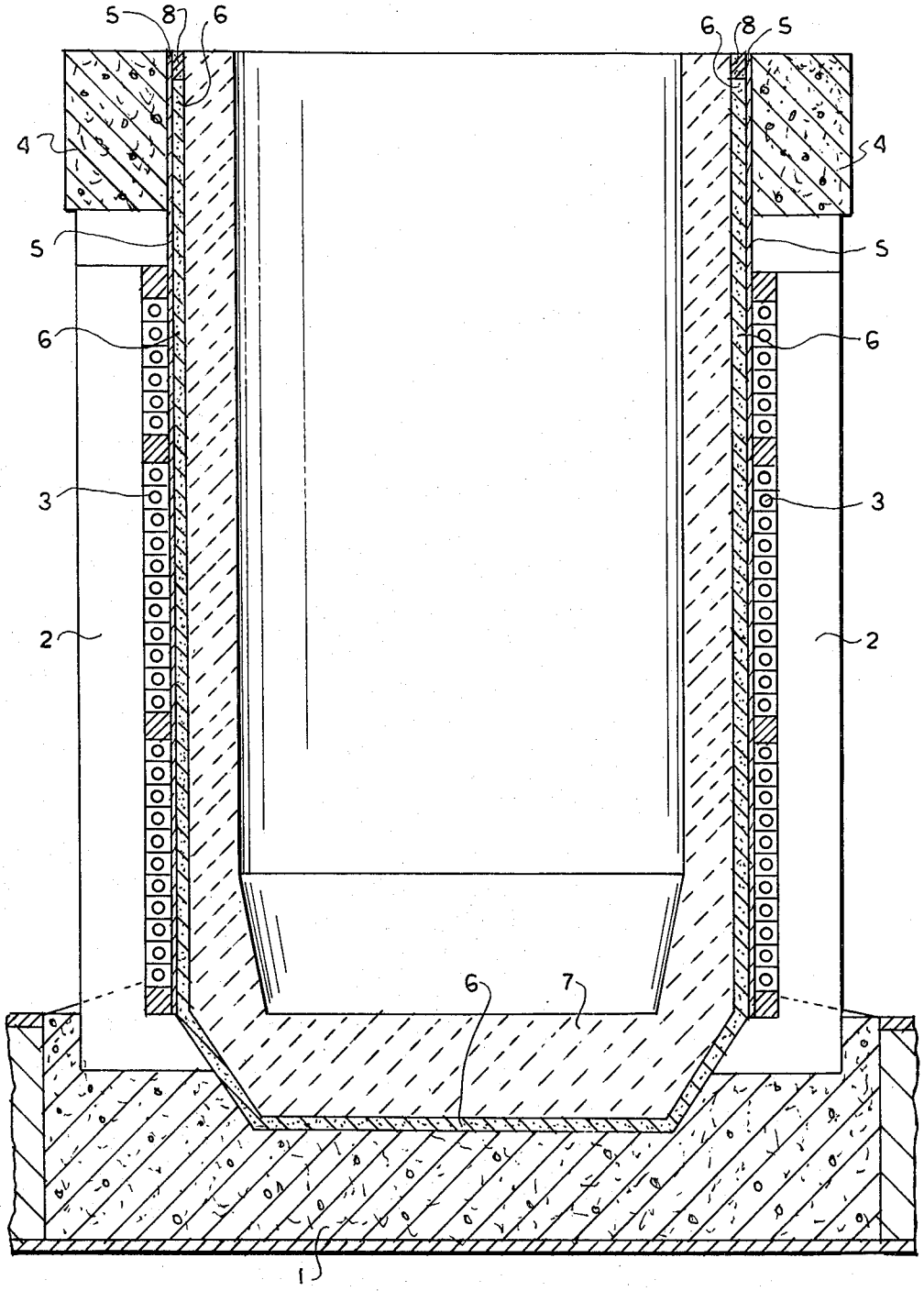
5
8
6
6
8
5
4
4
5
5
6
6
3
3
2
2
6
7
1

INDUCTION CRUCIBLE FURNACE AND METHOD FOR ITS PREPARATION

BACKGROUND OF THE INVENTION

The invention relates to an induction crucible furnace with a refractory lining prepared from a dry ramming material and a sintering agent, as well as a method for its production.

An induction crucible furnaces as known hitherto, the refractory lining in the approximate shape of a crucible is made by inserting a form into the furnace cage, and leaving a vacant space towards the furnace cage. A dry ramming material to which a sintering agent has been added, is filled in situ into the vacant space and compacted by vibration, and after the form has been removed is brought to temperatures causing sintering of the compacted dry ramming material, the form may, however, also be left in the furnace and will then be destroyed. It is of disadvantage therein, that the filling and compacting of the dry ramming compound is a laborious time-consuming procedure which, since the dry ramming material usually consisting of quartz or quartzite, will subject the operating personnel to considerable amounts of silicogenous dust. Relining after the old lining has been worn out, is also a very laborious procedure since the old, worn-out lining must be broken up in laborious, physically strenuous work, and wherein the danger of damage to the coils of the furnace remains present. In order to perform the aforegoing, the furnace must, of course, be cooled-down to a considerable extent.

With so-called crucible melting furnaces it has been known how to introduce prefabricated crucibles into the furnace to be prepared. Herein, however, clay-bonded graphite crucibles are used, which may be used in induction crucible furnaces only if the furnace is used exclusively for non-ferrous metals, this restriction constituting a disadvantage. Use of prefabricated crucibles consisting of such a material is, for metallurgical reasons, also not possible in induction crucible furnaces that process iron and steel as well. Furthermore, it has also been tried to use prefabricated crucibles in induction crucible furnaces. The former are produced from a ramming material and a sintering agent, and sintered at a location external to the induction furnace. Sintering at a location external to the furnace has proved to be hardly controllable. Until definite full sintering, the quartz of the dry ramming material is undergoing several transformation with strong growing of the granules, processes which are partly reversible, and by which a crucible of this type will be loosened to too great an extent, become fragile and very brittle, so that it can thus hardly be transported or handled.

SUMMARY OF THE INVENTION

It is an object of the invention to improve an induction crucible furnace. The present invention is based upon the objective of creating an induction crucible furnace of the type of this category, and to make available a method by which the induction furnace may be prepared particularly rapidly and simply, and also be relined in the same manner when the refractory lining has become worn out.

The objects of the invention are attained by provision of an induction crucible furnace comprising a housing including a bottom wall and side walls to define a furnace cage, a prefabricated crucible positioned in the furnace cage with a peripheral boundary clearance and a plurality of induction coils surrounding the crucible. In the clearance between the interior of the furnace cage and the outer peripheral surface of the crucible a layer of non-sintering granular material is disposed which is closed from above with a patching material.

The possibility of using a prefabricated crucible denotes an extraordinary saving of time in the preparation of the crucible furnace. Herein, a crucible prefabricated in this manner, can be handled perfectly and well, since the cold-curing binder will ensure reliable bonding of the dry ramming material and the sintering agent. A crucible prefabricated in this manner, will not be of the extraordinate brittleness of crucibles that have been sintered or fired beforehand. Imbedding the prefabricated crucible in the bed of the furnace cage will also ensure herein that the crucible is held securely and perfectly in the cage when the furnace is started up for sintering the crucibles. It must be taken into consideration herein that the metallic charge will be subjected to an agitating motion by the forces of induction and that mechanical vibratory stresses may act upon the crucible that has not yet been sintered. Imbedding will also prevent cracking of the crucible during the phase in which it changes its final strength by sintering, and wherein the coldcuring binder is decomposing during sintering.

A special advantage results from using non-sintering granular material for imbedding. If a crucible of this type has become worn out, the furnace may be furnished with a new crucible, in the most simple manner conceivable, i.e. by tilting the furnace, thus allowing the granular material to flow out after removal of the edge seal provided for the operating phase. After the granular material, which has not become solified by sintering during the usual operating temperatures of the induction crucible furnace has run out, the wornout crucible is virtually exposed and free within the furnace cage and may readily be lifted out from it. These manipulations may be performed even at higher furnace temperatures if requisite lifting tackle is used, so that the long waiting periods as customary hitherto to allow the furnace to cool off are thus obviated.

An embodiment of the object of the invention is described hereinbelow with reference taken to the enclosed drawing.

BRIEF DESCRIPTION OF THE DRAWING

The drawing shows an induction crucible furnace as per invention, in a schematic cross section.

DETAILED DESCRIPTION OF THE PREFERRED EMBODIMENT

The cage of the induction crucible furnace consists in the usual manner of a bottom section 1 made of fire concrete, carrying the yokes 2 and the induction coils 3. A ring 4 of fire concrete is arranged above the yokes. Particularly the coils 3 are protected towards the inside against excessive heat by means of an attenuating layer 5. The attenuating layer is usually of a thickness of 1 to 5 mm and may, for instance, consist of micanite and/or asbestos.

In preparing the induction crucible furnace, the furnace cage which has been made ready, is first provided at its bottom with a bed formed from nonsintering granular material. After this preparation, a previously fabricated crucible 7 is set upon the bed at the bottom side, with dimensioning having been made so as to allow for a narrow free space between the furnace cage and the prefabricated crucible 7. This free space is then again packed with the nonsintering granular material, whereafter the material 6 is compacted by a vibratory process in such a manner that the prefabricated crucible 7 is imbedded into the material 6 firmly and securely on all sides.

In the above, the crucible 7 is formed by the dry ramming material customary for the refractory lining of such induction crucible furnaces, to which a sintering agent has been added. In order to give the prefabricated crucible the strength required for being handled, a cold-curing binder is added for bonding the dry ramming material together.

A dry ramming material of this type will customarily consist of quartz and/or quartzite with a granulation of 0 to 7 mm. The usual binders are boric acid and boric acid anhydride. Synthetic resins such as, for instance, phenolic or furan resins have proven themselves well suited as binders, as have also water glass, organic silica compounds and phosphates.

Sand of a special granulation, dry ramming material crushed stone and also gravel of fine granulation have proven to be well suited as non-sintering granular material for the solid imbedding of the prefabricated crucible.

Since it will not be necessary any longer to pack and vibrate dry ramming material for producing the refractory lining in preparing the induction crucible furnace, the operating personnel will either not be subjected in any way to silicogenous dust or such hazard will be reduced to a minimum when using a non-sintering granular material as dry ramming material for imbedding the prefabricated crucible.

To suit the purpose, the space for holding the non-sintering granular material will not be completely filled with same. A small space is left free at the upper peripheral edge and then sealed by trowelling with a patching compound, a customary material, hardening at the usual operating temperature of such induction crucible furnaces, which will keep the non-sintering granular material enclosed during furnace operation, particularly when the furnace is being tilted.

When the induction crucible furnace has been prepared to the above extent, it is being started in the usual manner, either by means of a starting ingot or by charging the cold furnace with molten metal, and brought up to temperatures causing sintering of the prefabricated crucible 7. The crucible 7 will have reached its definite hardness and strength thereafter. Whilst the prefabricated crucible 7 will reach its final strength by sintering brought about by the added sintering agent, the cold-curing binder will decompose at these temperatures.

During this sintering phase of the crucible, it is firmly supported against mechanical stresses, including vibratory stresses caused by inductive forces, by being imbedded into the non-sintering granular material 6.

When the crucible 7 has become worn out and the induction crucible furnace is to be provided with a new refractory lining, it will suffice in a conceivably simple manner, to tilt the furnace slightly over the horizontal, and to destroy at a suitable location the patching compound 8 sealing the material 6, so that the material 6 will simply flow out of the furnace. The worn-out crucible is now removed by means of a lifting tackle. Removal of the worn-out crucible may be made with a virtually still hot furnace. A new prefabricated crucible is then inserted in the aforenoted manner.

We claim:

1. An induction crucible furnace, comprising a housing including a bottom wall and side walls to define a furnace cage having an interior; a prefabricated crucible made of mixture of dry ramming material, sintering agent and cold-curing binder without application of elevated temperature and thereby without sintering the crucible, said crucible being positioned in said cage and having an outer peripheral surface; a plurality of induction coils surrounding said crucible and mounted on said side walls, said prefabricated crucible being positioned within the interior of said cage so that a peripheral boundary region is provided between the interior of said cage and said outer peripheral surface of said crucible; and a layer of non-sintering granular material disposed in said region, said layer being closed at the top thereof to secure the layer within the furnace.

2. The induction crucible furnace of claim 1, wherein said layer being closed by a seal of a patching compound, said seal being flush with the upper edge of the furnace.

3. The induction crucible furnace of claim 2, wherein a heat-protective layer is disposed between said layer of non-sintering granular material and said induction coils.

4. A method of manufacturing an induction crucible furnace having a furnace cage with a bottom wall and side walls and a plurality of induction coils surrounding the cage, comprising the steps of forming a prefabricated crucible of mixed dry ramming material, sintering agent and cold-curing binder without application of elevated temperatures and thereby without sintering the crucible; preparing a bed of a non-sintering granular material at the bottom wall of the furnace cage, placing the prefabricated crucible onto said bed so as to provide an annular boundary region between the interior of the furnace cage and the prefabricated crucible; filling said region with non-sintering granular material; compacting the non-sintering granular material within said region up to a relatively short distance below the upper edge of the furnace to provide an annular space therein; closing said annular space; and starting up the furnace to reach the temperature causing sintering of the mixture of the prefabricated crucible.

5. The method of claim 4, wherein closing said annular space includes a step of filling a patching compound into said space.

* * * * *